US006840398B1

(12) United States Patent
Blumenschein

(10) Patent No.: US 6,840,398 B1
(45) Date of Patent: Jan. 11, 2005

(54) PLASTIC RECEPTACLE WITH LID

(75) Inventor: Marcus Blumenschein, Marienheide (DE)

(73) Assignee: Jokey Plastik Wipperfurth GmbH (DE)

( * ) Notice: Subject to any disclaimer, the term of this patent is extended or adjusted under 35 U.S.C. 154(b) by 0 days.

(21) Appl. No.: 09/857,086

(22) PCT Filed: Nov. 12, 1999

(86) PCT No.: PCT/DE99/03605

§ 371 (c)(1),
(2), (4) Date: Jul. 9, 2001

(30) Foreign Application Priority Data

Dec. 1, 1998 (DE) ..... 198 55 361

(51) Int. Cl.[7] ..... B65D 43/06

(52) U.S. Cl. ..... 220/782; 220/380; 220/790; 220/789; 206/508

(58) Field of Search ..... 220/380, 780–782, 220/789, 790; 206/508, 511, 515

(56) References Cited

U.S. PATENT DOCUMENTS

| | | | | | |
|---|---|---|---|---|---|
| 3,515,306 | A | * | 6/1970 | Roper | 220/792 |
| 3,632,016 | A | | 1/1972 | Bozek | |
| 3,989,142 | A | * | 11/1976 | Gwilliam et al. | 206/508 |
| 4,051,951 | A | * | 10/1977 | Smith | 206/508 |
| 4,227,625 | A | * | 10/1980 | Underwood | 215/358 |
| 4,700,842 | A | | 10/1987 | Grusin | |
| D339,525 | S | * | 9/1993 | Morris, Sr. | D9/434 |
| 5,303,839 | A | | 4/1994 | Blumenschein | |
| 5,540,349 | A | * | 7/1996 | Philips | 206/508 |
| 6,273,291 | B1 | * | 8/2001 | Conti | 206/503 |

FOREIGN PATENT DOCUMENTS

| | | | |
|---|---|---|---|
| DE | 84 29 165 | U1 | 1/1985 |
| DE | 88 04 303 | U | 6/1988 |
| DE | 43 06 982 | A1 | 9/1994 |
| DE | 44 22 534 | A1 | 8/1995 |
| EP | 0 447 693 | A1 * | 9/1991 |
| EP | 0 870 690 | A1 | 10/1998 |
| HU | 217516 | B | 2/2000 |

OTHER PUBLICATIONS

Notice of Opposition correspondonce from EPO of Jun. 10, 2003 against European Pat. No. 1 135 303 titled "Kunststofbehälter mit deckel" in the name of Jokey Plastik Wipperfürth GmbH, pp. 1–12.

Attestation (in French) dated Sep. 11, 2001 by Sylvie Brabant with drawing, pp. 1–2 (D1).

(List continued on next page.)

*Primary Examiner*—Robin A. Hylton
(74) *Attorney, Agent, or Firm*—Brooks Kushman P.C.

(57) ABSTRACT

Disclosed is a plastic receptacle having a lid (1). The receptacle includes an upper edge and the lid (1) includes an area (2) encompassing the upper edge. The area (2) includes a side (3) which radially faces inwards. The lid also includes a middle area (4) surrounded by the first area (2) and an outer area (5) extending downwards. Furthermore, the lid (1) is provided with box-shaped projections (6) on its side (3) which radially faces inwards. The aim of the invention is to achieve better centering and better stability of the stacked-up receptacles having lids (1) by maintaining a low stack height of the lids (1). To this end, the side (3) of the lid (1) which faces radially inwards has a surrounding terracing (7) which has approximately the same width as the projections (6) and the projections (6) are arranged on the terracing (7) and extend to the upper edge of the encompassing area (2) of the lid (1).

10 Claims, 2 Drawing Sheets

OTHER PUBLICATIONS

Figure 1:
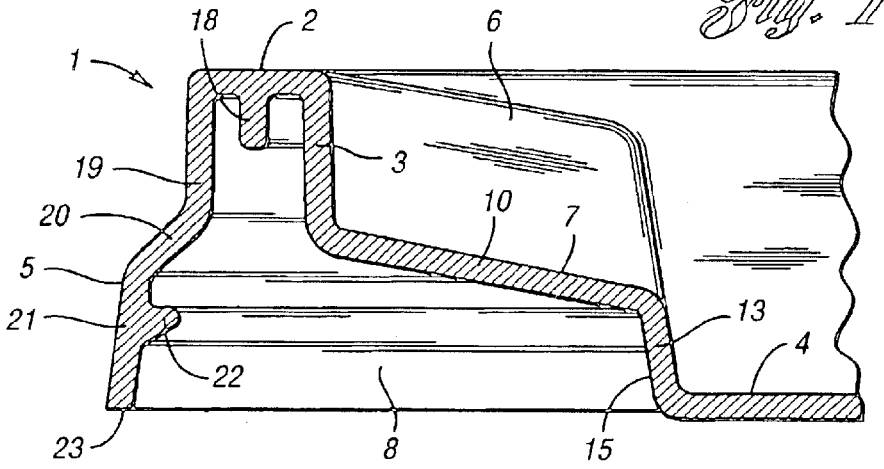

Attestation (in French) dated Feb. 14, 2002 by Philippe Louvrier with drawing No. 461308 marked L053, pp. 1–7 (D2).
Attestation (in French and English) dated Feb. 18, 2002 by Jerome Leroy with drawing No. 961308 marked L053 and dated Oct. 1998 (D3).
Fax dated Mar. 19, 2002 of purchase agreement for lid L053 dated Jun. 30, 1998 (D4).
Figures 0–3 referenced in Notice of Opposition of Jun. 10, 2003, pp. 1–4 (D5).
Emballage 98, Pare es Expositions, Nov. 16–20, 1998, Somagic Industries (D9).

* cited by examiner

PLASTIC RECEPTACLE WITH LID

The invention relates to a plastic receptacle with lid, where the receptacle comprises an upper edge and the lid comprises an area encompassing said upper edge and comprising a side, which faces radially inwards, a middle area surrounded by the first area and an outer area extending downwards, and where the lid is provided with box-shaped projections on its side facing radially inwards, which connect the side facing radially inwards to the middle area of the lid.

A plastic receptacle with lid of this kind is known from DE 44 22 534 A1. The box-type projections, which connect the radially inward-facing side of the lid to its middle area, significantly increase the stiffness of the lid at the edges, without making it more difficult to remove the lid from the plastic receptacle. In addition, the projections facing radially inwards facilitate the centring of the receptacles when stacked on top of one another.

In the known plastic receptacle with lid, the projections facing radially inwards are of relatively flat design, in order to achieve a relatively low stacking height of lids stacked on top of one another. When receptacles are stacked on top of one another, this can cause the uppermost receptacle to slide over the projections in response to laterally acting forces and thus to lose its centring effect.

Consequently, the object of the invention is to achieve better centring of the receptacles during stacking, without having to dispense with the other advantages of the known receptacle, particularly the low stacking height of the lids.

According to the invention, the objective is solved in that the side of the lid facing radially inwards has a surrounding terracing, which has approximately the same width as the box-type projections, and the box-type projections are arranged on the terracing and extend up to the upper edge of the encompassing area of the lid.

Increasing the height of the projections would not in itself solve the objective on which the invention is based, as the stacking height of the lids would increase accordingly. The decisive aspect is the arrangement of the box-type projections on a surrounding terracing, which has approximately the same width as the box-type projections and permits the stacked lids to be centred in such a way that the projections of an underlying lid support the lid stacked on top exclusively on the inside surface of the terracing. As a result, stacked lids can be rotated relative to one another without the box-type projections of an underlying lid engaging the inside of the box-type projections of a lid stacked on top and thus creating a snap connection preventing further rotation. When lids are stacked, the top side of the box-type projections expediently contacts the inside surface of the top side of the terracing and the radially inward-facing side of the projections contacts the inside surface of the radially inward-facing side of the terracing. Due to the slight slope of the radially inward-facing sides of the terracing and the projections, the outside surfaces of the projections contact the inside surface of the terracing in such a way that the outside surface of the top side of the projections comes to rest at the height of the inside surface of the top side of the terracing or somewhat below it. The stacked lids can then easily be rotated relative to one another, without the projections catching on each other. This achieves an optimally low stacking height of the lids, which is determined by the difference in height between the inside surface of the top side of the terracing and the outside surface of the top side of the box-type projections.

In a preferred configuration, the surrounding terracing is therefore designed as a circumferential, stepped depression and the box-type projections as box-type recesses in the depression.

In an expedient configuration of the invention, the radially inward-facing side areas between the projections continue on the underside of the lid in the form of sealing webs in the region of the box-type projections, so that a closed, circumferential sealing wall is formed to contact the upper edge of the receptacle.

This configuration is particularly suitable for a plastic receptacle whose upper edge is designed as a sealing edge, such as in the form of a sealing lip, which comes into tight contact with the radially inward-facing side of the lid in the region surrounding the edge of the receptacle. The closed, circumferential sealing wall with the sealing webs in the region of the box-type projections ensures reliable sealing between the lid and the upper edge of the receptacle.

The box-type projections can be of various designs. Projections with a substantially trapezoidal base area (in the top view) have proved to be expedient. However, the projections can also have a substantially wave-shaped base area or some other base area (in the top view).

In a preferred configuration, the top side of the surrounding terracing slopes slightly down towards the inside.

The top side of the box-type projections expediently has the same slope, so that the outside surface of the top side of the projections can contact the inside surface of the top side of the terracing with little play.

It is also expedient for the radially inward-facing side of the box-type projections to be slightly sloped. When the lids are centred on top of one another, the outside surface of the radially inward-facing sides is then in contact with the inside surface of the radially outward-facing side of the terracing, such that the outside surface of the top side of the projections is at the same height as the inside surface of the top side of the terracing, or below it, with some degree of play.

The radially inward-facing side of the box-type projections is preferably concave in the circumferential direction, with a radius corresponding to the distance between the projections and the centre point of the lid on its top side.

For reasons of stability, it is furthermore expedient for the intermediate spaces between the box-type projections to be substantially equal in size to the box-type projections.

A preferred practical example of the invention is described in detail below on the basis of the drawings.

Figure 2:
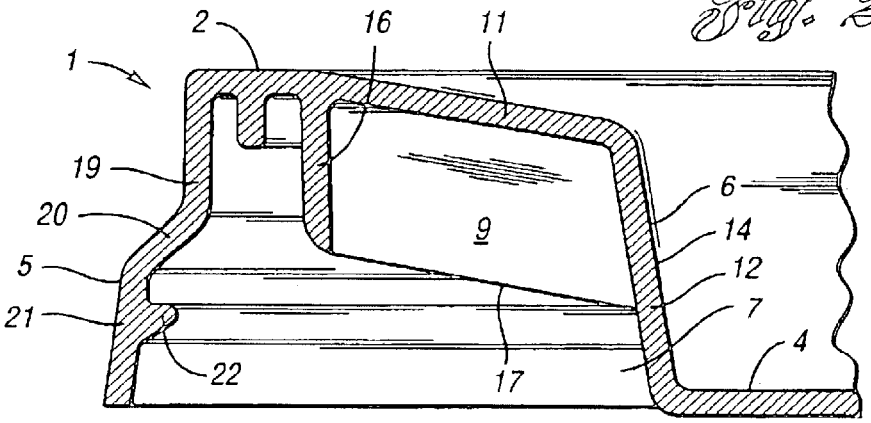
Figure 3:
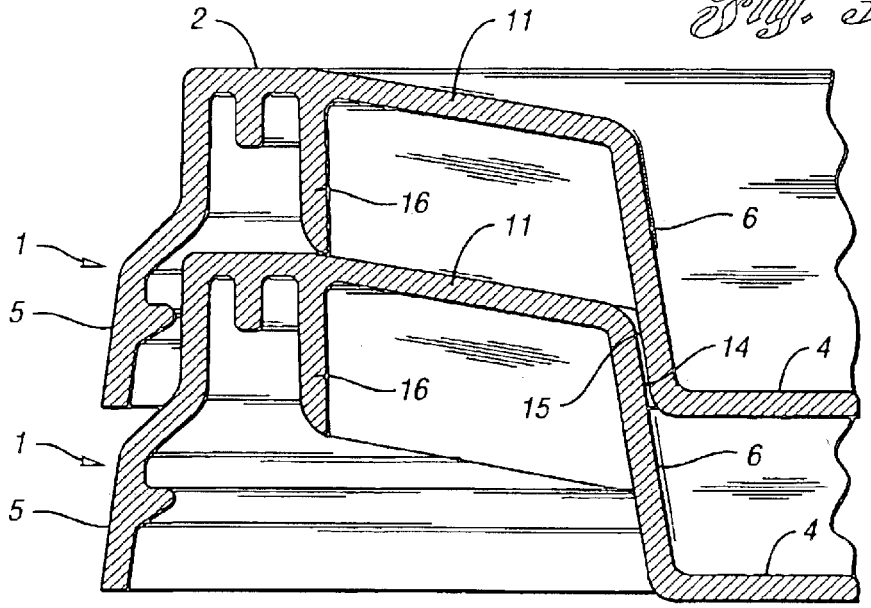
Figure 4:
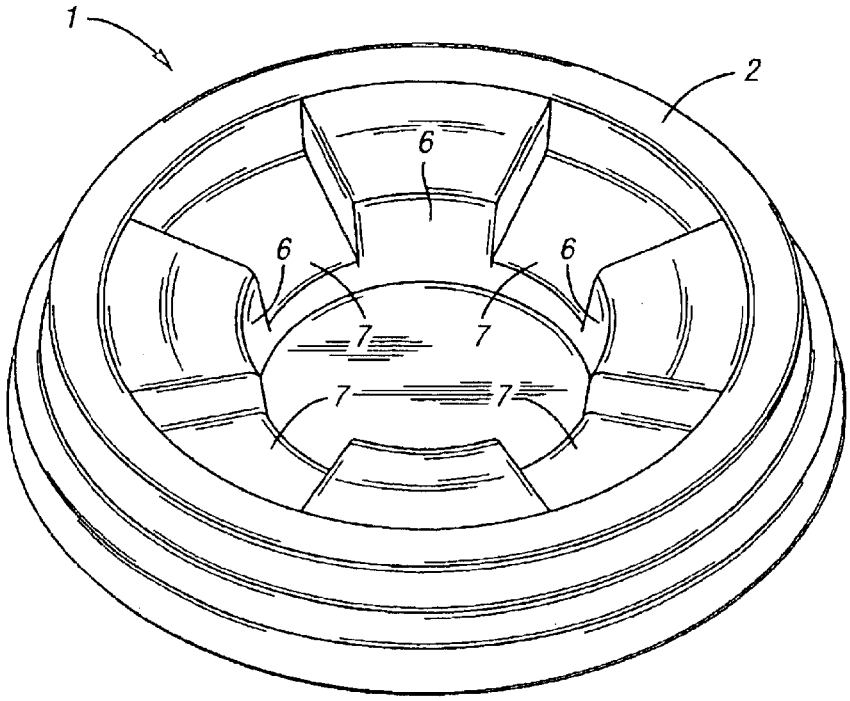
Figure 5:
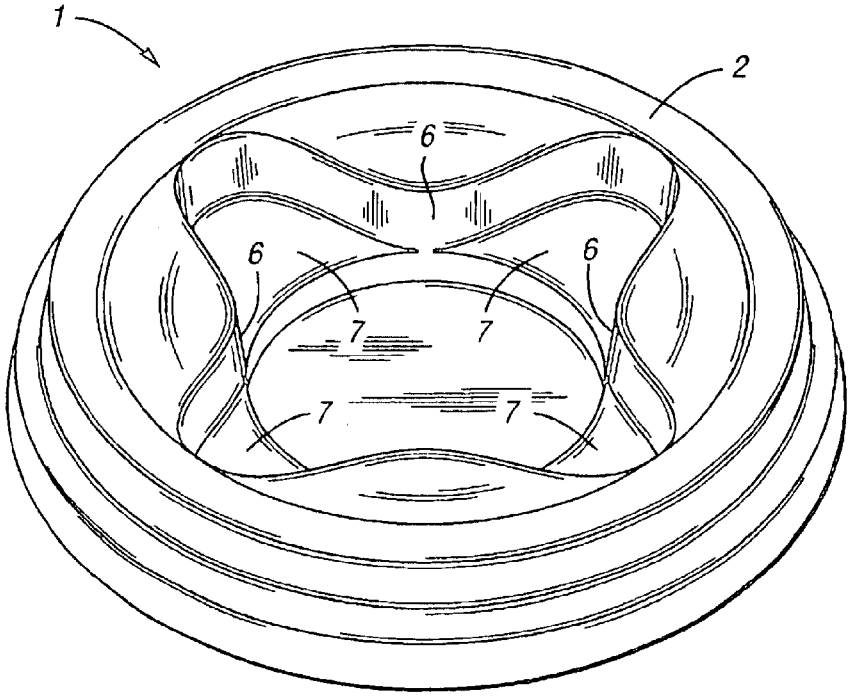

The drawings show the following:

FIG. 1 A partial view of a radial section through a lid in the edge region,

FIG. 2 A partial view of a radial section through the lid in the region of a projection, FIG. 3 A partial view of a section through several stacked lids, FIG. 4 A top view of an embodiment of a lid of the present invention, and FIG. 5 A top view of another embodiment of a lid of the parent invention.

As shown in FIGS. 1 and 2, lid 1 illustrated there has an area 2 which encompasses the upper edge (not shown) of a receptacle and comprises a radially inward-facing side 3, a middle area 4 surrounded by area 2, and an outer area extending downwards 5. Radially inward-facing side 3 of lid 1 is further provided with box-shaped projections 6, which connect radially inward-facing side 3 to middle area 4 of lid 1.

As FIGS. 1 and 2 also show, radially inward-facing side 3 of lid 1 has a surrounding terracing 7 of roughly the same width as box-type projections 6. Box-type projections 6 are arranged on terracing 7 and extend upwards to the upper edge of encompassing area 2 of lid 1.

On the underside of the lid, surrounding terracing 7 is designed as a circumferential, stepped depressed 8 and box-shaped projections 6 as box-shaped recesses 9 in depression 8. Top side 10 of surrounding terracing 7 is slightly sloped towards the inside. Top wall 11 of box-type projections 6 has the same slope. Radially inward-facing sides 12 and 13 of box-type projections 6 and terracing 7 are also slightly sloped. Terracing 7 and box-type projections 6 are designed in such a way that, when lids 1 are stacked on top of one another in their centered position, sidewall 14 of projections 6 contacts the inside surface of terracing 7 and top side 11 of projections 6 is adjacent to top side 10 of terracing 7 or slightly below it with little play. In the stacked position shown in FIG. 3, lids 1 can be rotated relative to one another without projections 6 of an underlying lid catching in inside recesses 9 of projections 6 of the lid stacked on top. In this context, the stacking height is determined only by the height of projections 6 arranged on terracing 7 and the thickness of top side 10 of terracing 7, and not, however, by the height of terracing 7.

Like radially inward-facing side 13 of surrounding terracing 7, radially inward-facing side 12 of projections 6 is concave, with a radius approximately equal to the distance between projections 6 and the center point of lid 1 on its top side. Due to the slightly conical, cylindrical surface of radially outward-facing sides 12 and 13 of projections 6 and terracing 7, optimum centering of stacked receptacles with lids 1 is achieved.

The intermediate spaces between box-type projections 6 are roughly the size of box-type projections 6.

In the practical example shown in the drawing, the receptacle (not shown) has an upper sealing edge, which is in tight, pretensioned contact with radially inward-facing side 3 of encompassing area 2 of lid 1. To this end, it is necessary for the radially inward-facing side areas of lid 1 between projections 6 to continue on the underside of the lid in the form of sealing webs 16 in the region of box-shaped projections 6, so that a closed, circumferential sealing wall is formed to contact the upper edge of the receptacle. In order to stabilise sealing webs 16, ribs 17 are arranged between them, top wall 11 and radially inward-facing side 12 of projections 6.

A cylindrical, downward-facing sealing lip 18 is integrally moulded on encompassing area 2 at a distance from sealing webs 16 or radially inward-facing side 3 of encompassing area 2. Radially outside sealing lip 18 and at a distance from it, encompassing area 2 of the lid transitions into outer area extending downwards 5. This area consists of a roughly vertical section 19, which transitions into a steeply sloped section 20 and a slightly sloped end section 21. The more steeply sloped section 20 has a slope of approximately 45°, while the less sloped end section 21 has a slope of approximately 7°. Both sections serve as sliding surfaces, which prevent adjacent receptacles from catching and damaging one another in the region of the seal. The angle between slightly sloped end section 21 and the vertical should not be too large, in order to prevent lid 1 from coming off the receptacle as a result of transverse forces against the receptacle wall and area extending downwards 5 of lid 1. At greater angles, most of the forces are deflected vertically, so that lid 1 can come off the receptacle. Therefore, the angle of inclination of slightly sloped end section 21 to the vertical should be less than 10°, preferably between 9° and 3°.

The receptacle associated with lid 1 shown in the drawing has a circumferential web on its outer side, the end of which facing away from the receptacle wall transitions into a downward-facing, collar-like area that surrounds the receptacle wall at a distance. The circumferential web has the same slope as steeply sloped section 20 of lid 1 and is arranged in such a way that steeply sloped section 20 contacts the circumferential web of the receptacle when the lid is fitted on the receptacle.

The transitional area to the downward-facing, collar-like area of the receptacle is provided with a recess, which a radially inward-facing, circumferential projection 22 on area extending downwards 5 of lid 1 snaps into. Area extending downwards 5 of lid 1 is integrally moulded on encompassing area 2 of lid 1 such that it contacts the circumferential web of the receptacle under pretension when in the engaged position.

Furthermore, the circumferential web of the receptacle is provided outside the recess with a horizontal terracing, on which lower edge 23 of area extending downwards 5 of the lid rests under pretension. In this context, the outside surfaces of area extending downwards 5 of lid 1 and of the downward-facing, collar-like area of the receptacle are flush, so that no intermediate spaces are formed that would otherwise allow adjacent receptacles with lids to catch on one another.

LIST OF REFERENCE NUMBERS

1 Lid
2 Encompassing area
3 Radially inward-facing side
4 Middle area
5 Outer area extending downwards
6 Projection
7 Terracing
8 Depression
9 Recess
10 Top side of the terracing
11 Top side of the projections
12 Radially inward-facing side of the projections
13 Radially inward-facing side of the terracing
14 Outside surface of the projections
15 Inside surface of the terracing
16 Sealing web
17 Rib
18 Sealing lip
19 Vertical section
20 Steeply sloped section
21 Slightly sloped section
22 Projection
23 Edge

What is claimed is:

1. A plastic receptacle with lid (1) where the receptacle comprises an upper edge and the lid (1) comprises a first area (2) encompassing said upper edge and comprising a side (3), which faces radially inwards, a middle area (4) surrounded by the first area (2) and an outer area (5) extending downwards, and where the lid (1) is provided with box-shaped projections (6) on its side (3) facing radially inwards, which connect the side (3) facing radially inwards to the middle area (4) of the lid (1), characterised in that the side (3) of the lid (1) facing radially inwards has a surrounding terracing (7), which has approximately the same width as the projections (6), and the projections (6) are arranged on the terracing (7) and extend up to the upper edge of the encompassing area of the lid (1), the box-shaped projections (6) having a base area, sidewalls (14) adjacent to edges of the base area and a top wall (11).

2. The plastic receptacle with lid as per claim 1, characterised in that, on the underside of the lid, the surrounding terracing (7) is designed as a circumferential, stepped depression (8) and the projections (6) as box-shaped recesses (9) in the depression (8).

3. The plastic receptacle with lid as per claim 1, characterised in that the radially inward-facing side areas of the lid (1) between the projections (6) continue on the underside of the lid in the form of sealing webs (16) in the region of the projections (6), so that a closed, circumferential sealing wall is formed to contact the upper edge of the receptacle.

4. The plastic receptacle with lid as per claim 1, characterised in that the projections (6) have a substantially trapezoidal base area in a top facing view.

5. The plastic receptacle with lid as per claim 1, characterised in that the projections (6) have a substantially wave-shaped base area in a top facing view.

6. The plastic receptacle with lid as per claim 1, characterised in that a top side (10) of the surrounding terracing (7) slopes slightly down radially inwards.

7. The plastic receptacle with lid as per claim 1, characterised in that the top walls (11) of the projections (6) are slightly sloped radially inwards.

8. The plastic receptacle with lid as per claim 1, characterised in that radially inward-facing sides (12, 13) of the projections (6) and the terracing (7) are slightly sloped.

9. The plastic receptacle with lid as per claim 1, characterised in that the radially inward-facing sides of the projections (6) are concave in the circumferential direction, with a radius corresponding approximately to the distance between the projections (6) and the center point of the lid (1) on its top side.

10. The plastic receptacle with lid as per claim 1, characterised in that intermediate spaces between the projections (6) are substantially equal in size to the projections (6).

* * * * *

UNITED STATES PATENT AND TRADEMARK OFFICE

CERTIFICATE OF CORRECTION

PATENT NO. : 6,840,398 B1
DATED : January 11, 2005
INVENTOR(S) : Blumenschein

It is certified that error appears in the above-identified patent and that said Letters Patent is hereby corrected as shown below:

Title page,
Item [*] Notice, delete "0" and insert -- 367 --.

Signed and Sealed this

Thirtieth Day of August, 2005

JON W. DUDAS
*Director of the United States Patent and Trademark Office*